United States Patent [19]

Coxe

[11] 4,021,007

[45] May 3, 1977

[54] PITCH-YAW STABILIZATION SYSTEM

[75] Inventor: Frank S. Coxe, Santa Ana, Calif.

[73] Assignee: Northrop Corporation, Los Angeles, Calif.

[22] Filed: Oct. 11, 1974

[21] Appl. No.: 514,243

[52] U.S. Cl. ..... 244/3.13; 250/203 R

[51] Int. Cl.[2] ..... F41G 7/14; F41G 9/00; F41G 7/00

[58] Field of Search ..... 244/3.13, 3.16; 250/203

[56] References Cited

UNITED STATES PATENTS

| | | | |
|---|---|---|---|
| 3,551,057 | 12/1970 | Hamilton et al. | 250/203 R |
| 3,807,658 | 4/1974 | Miller et al. | 244/3.13 |
| 3,848,830 | 11/1974 | Born | 244/3.16 |

*Primary Examiner*—Samuel W. Engle
*Assistant Examiner*—Thomas H. Webb
*Attorney, Agent, or Firm*—Frank S. Coxe

[57] ABSTRACT

A laser beamrider projectile having a lens system and a four-quadrant photodiode detector, which eliminates the need for rate gyros in the projectile to provide stabilization. When the projectile is aligned with the beam, the beam image is centered on the intersection of the four quadrants of the detector, and when the projectile pitch or yaw angle deviates, more light strikes one or two of the quadrants than the others. Comparison circuitry connected to the detector outputs provides one error signal proportional to pitch angle deviation and another error signal proportional to yaw angle deviation. These signals are usable by the projectile flight control system to eliminate oscillation in pitch and yaw. Preferably, an angle rate signal is also supplied to the stabilization system in addition to or instead of the angle deviation signal. The full specification must be consulted for an understanding of the invention.

4 Claims, 5 Drawing Figures

PITCH-YAW STABILIZATION SYSTEM

The present invention relates to flight vehicle stabilization, and more particularly, to a vehicle pitch and yaw stabilizer system which aligns the vehicle with a transmitted beam without oscillation.

Flight stabilization systems for prior art airborne vehicles such as missiles, aircraft drones, and the like which utilize electromagnetic signals transmitted from a ground station are used extensively, particularly for military applicatons and space control missions, in addition to the normal flight control and/or guidance systems. Such vehicles generally require a means of stabilization in pitch and yaw. Gyros are conventionally used to supply the angle and/or angle rate inertial or body-referenced data required by the vehicle autopilot to enable stabilization.

Since gyroscopes have many drawbacks, such as moving parts, weight, precession and others, it is an object of the present invention to provide a pitch-yaw stabilization system eliminating the need for gyros. Thus the present invention will also permit high acceleration in the case of a fired projectile, and temperature variations have essentially no effect on the performance. Also, no warm-up time is necessary as with gyros.

This invention can be adapted for use in an optical beamrider vehicle or in a command missile vehicle having an electromagnetic radio link between a remote transmitter and a receiver on board the vehicle. Briefly, my invention comprises a beam transmitter, a lens system and four-quadrant detector in the rear of the vehicle, with the lens axis coincident with or parallel to the longitudinal axis of the vehicle, and the beam image centered on the intersection of the four quadrants in the detector when the yaw angle and pitch angle of the vehicle are zero. The detectors are transducers which produce electrical signals which are preferably fed through normalizing circuits and then arithmetic operation circuitry to obtain a pitch error signal and a yaw error signal proportional to the deviation of the beam image from the intersection of the four quadrants in the respective pitch and yaw directions. Differentiating circuits change the measured error signals into rate-of-change signals for use by the autopilot or other stabilizing system governing the respective pitch and yaw controls of the vehicle.

This invention will be more fully understood by reference to the detailed description of a preferred embodiment to follow, and to the accompanying illustrative drawings, wherein.

Figure 1:
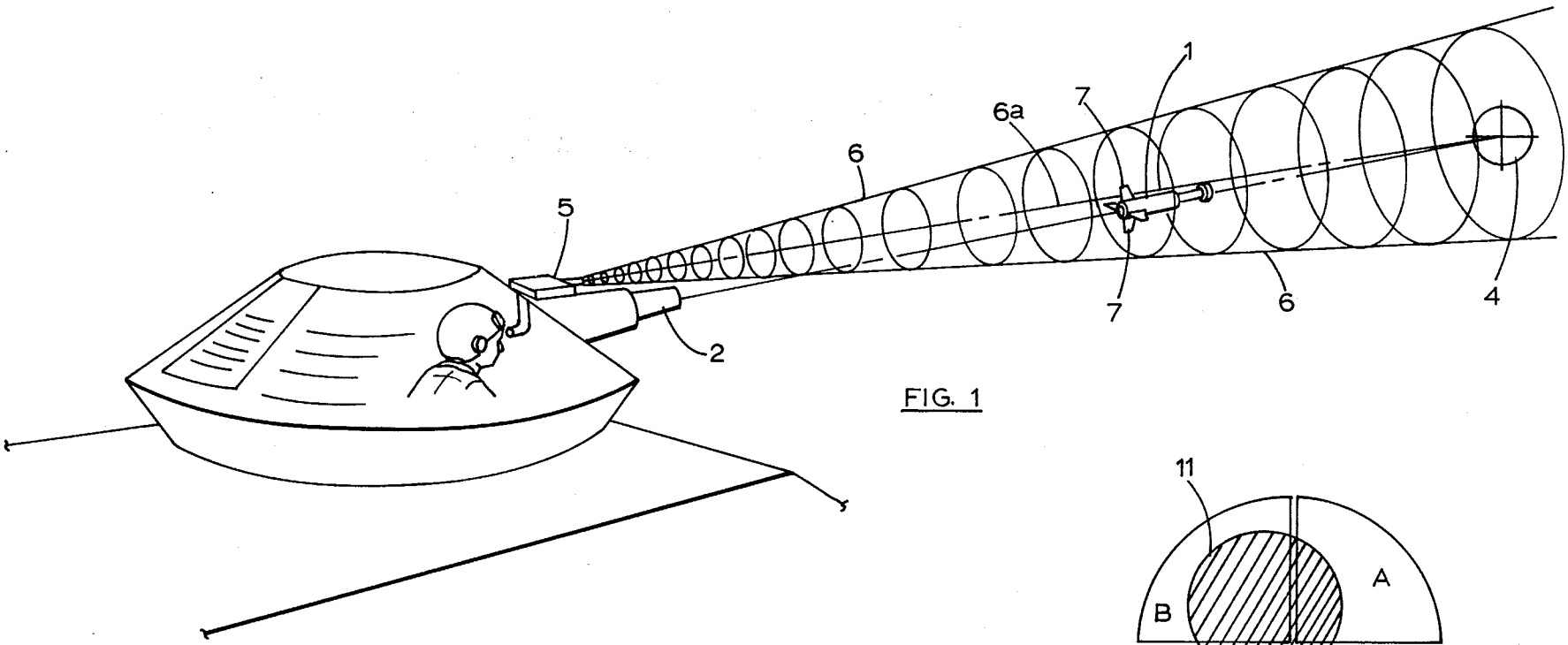
FIG. 1 is a pictorial drawing (not to scale) showing the present invention as applied to a laser beamrider projectile.

Referring first to FIG. 1 for a detailed description of a preferred apparatus incorporating the present invention, a projectile 1 has been fired from a launcher or gun 2 toward a target 4. A laser beam transmitter 5 is situated relatively near the gun 2, and the axis 6a of a laser beam 6 is pointed to the target 4, so that the beam axis is therefore substantially parallel to the flight line of the projectile 1. By "relatively near" the gun 2 is meant close enough so that the projectile 1 will enter the cone of the laser beam 6. Projectile 1 has four fins 7 (for example) for control and stabilization. The laser transmitter 5 comprises a pulsed laser diode and conventional optics to project a beam having about a one-degree divergence for example. The smaller the divergence angle, the brighter will be the received signal for a given transmitter 5.

Figure 2:
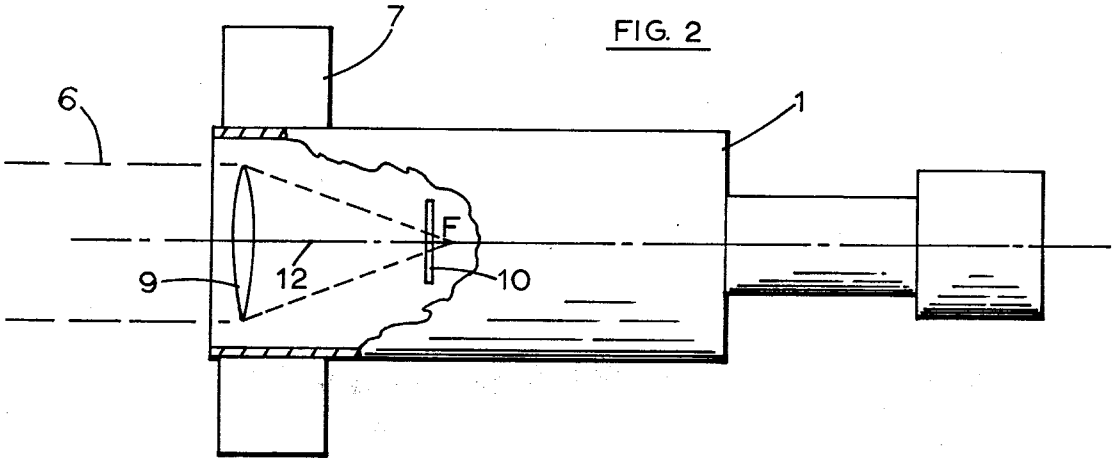
FIG. 2 is a schematic side view of the projectile showing the invention components in the projectile.
Figure 3:
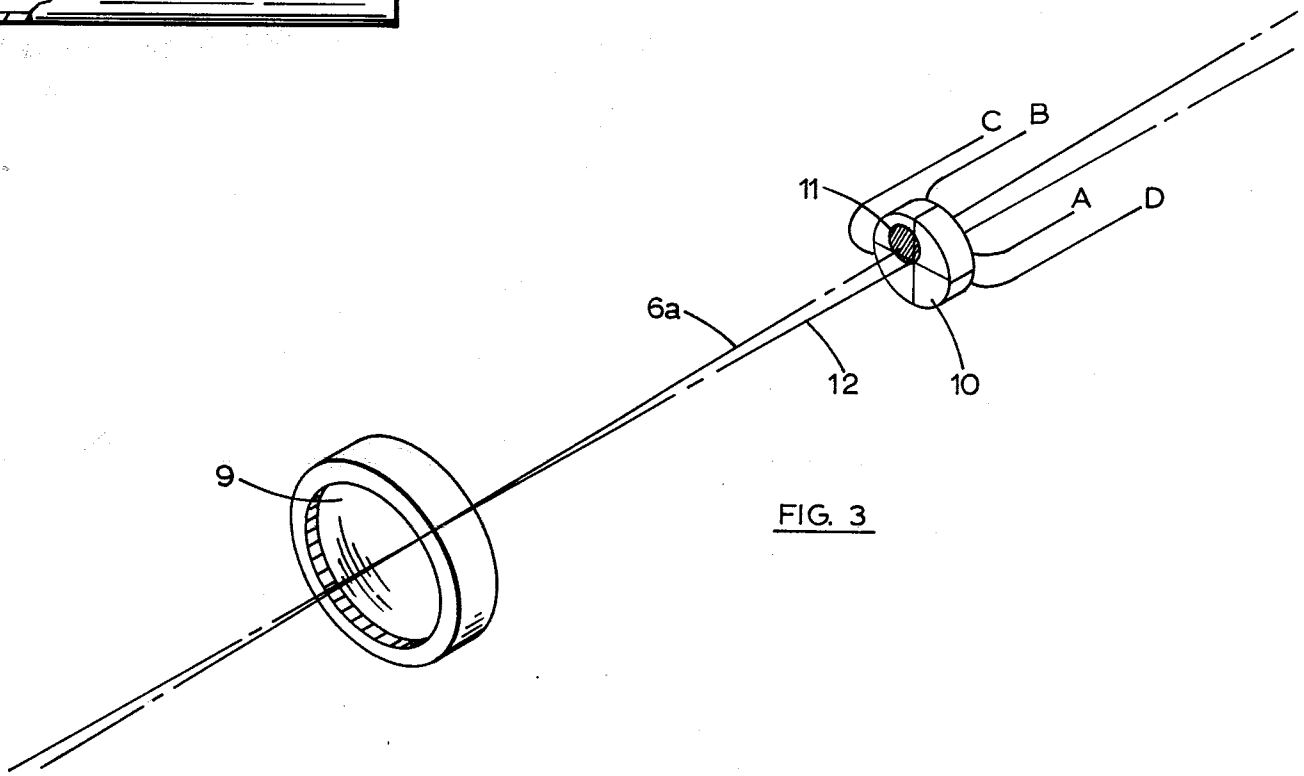
FIG. 3 is an isometric view of the invention components showing the optical relationship thereof.

As shown in FIGS. 2 and 3, the projectile 1 carries a focusing lens 9 which intercepts the laser beam 6 and focuses the light pulses at a theoretical focal point F. A four-quadrant detector assembly 10 is fixed forward of and parallel to lens 9 but spaced from focal point F so that a predetermined size of image appears as an essentially circular light spot 11 on the detector 10. The preferred diameter of this spot 11 is equal to the radius of the detector 10, although different sized spots can obviously be used in actual practice of the invention. Since the light rays of the laser pulses are essentially parallel to each other, coming from infinity with respect to the optics in the projectile 1, this spot size will remain relatively constant during the projectile flight. Spot diameter is determined in part by the distance from lens 9 to detector 10 and the focal length of lens 9.

Figure 4:
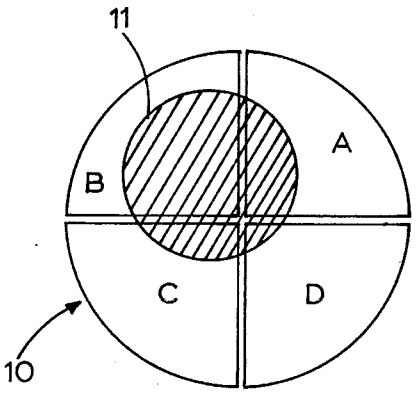
FIG. 4 is a rear elevation view of the four-quadrant detector with an example of a beam image thereon.

The four-quadrant detector 10 has four separate 90° sectors A, B, C & D, each comprisng a silicon photodiode, for example, having an active surface shaped as a quarter of a circle and positioned to form a horizontal and vertical axis with respect to the vehicle and intersecting at the center of the quadrants. See FIG. 4 also. The electrical output from each sector A, B, C and D is proportional to the amount of light striking it. For instance, in FIG. 4, the output from B would be highest, from A would be next highest, then C and D, respectively. If the longitudinal axis of the projectile 1 (corresponding to optical axis 12 in FIG. 3) is aligned with the laser beam axis 6a, the light spot 11 will be centered on the common intersection of the four sectors and the electrical output from each would be equal.

It is known that the difference between the sum of the lighted areas on A and B on the one hand and the sum of the lighted areas on C and D is a measure of the pitch angle deviaton of the projectile 1 from the laser beam axis 6a. Likewise the difference between the sum of the lighted areas on B and C and the sum of lighted areas on A and D is a measure of the yaw angle deviation of the projectile from the beam axis. In other words $(A+B)-(C+D)$ is proportional to pitch deviation angle and $(A+D)-(B+C)$ is proportional to yaw deviation angle, where A, B, C and D represent the output signals from the respective quadrants.

The normalized current from a detector quadrant varies practically linearly with the normalized displacement of the light spot 11 from the center. Pitch and yaw correction signals derived in the manner explained in the preceding paragraph can be fed to the projectile control fins 7 and null out any oscillations of the projectile about its pitch and yaw axes.

Figure 5:
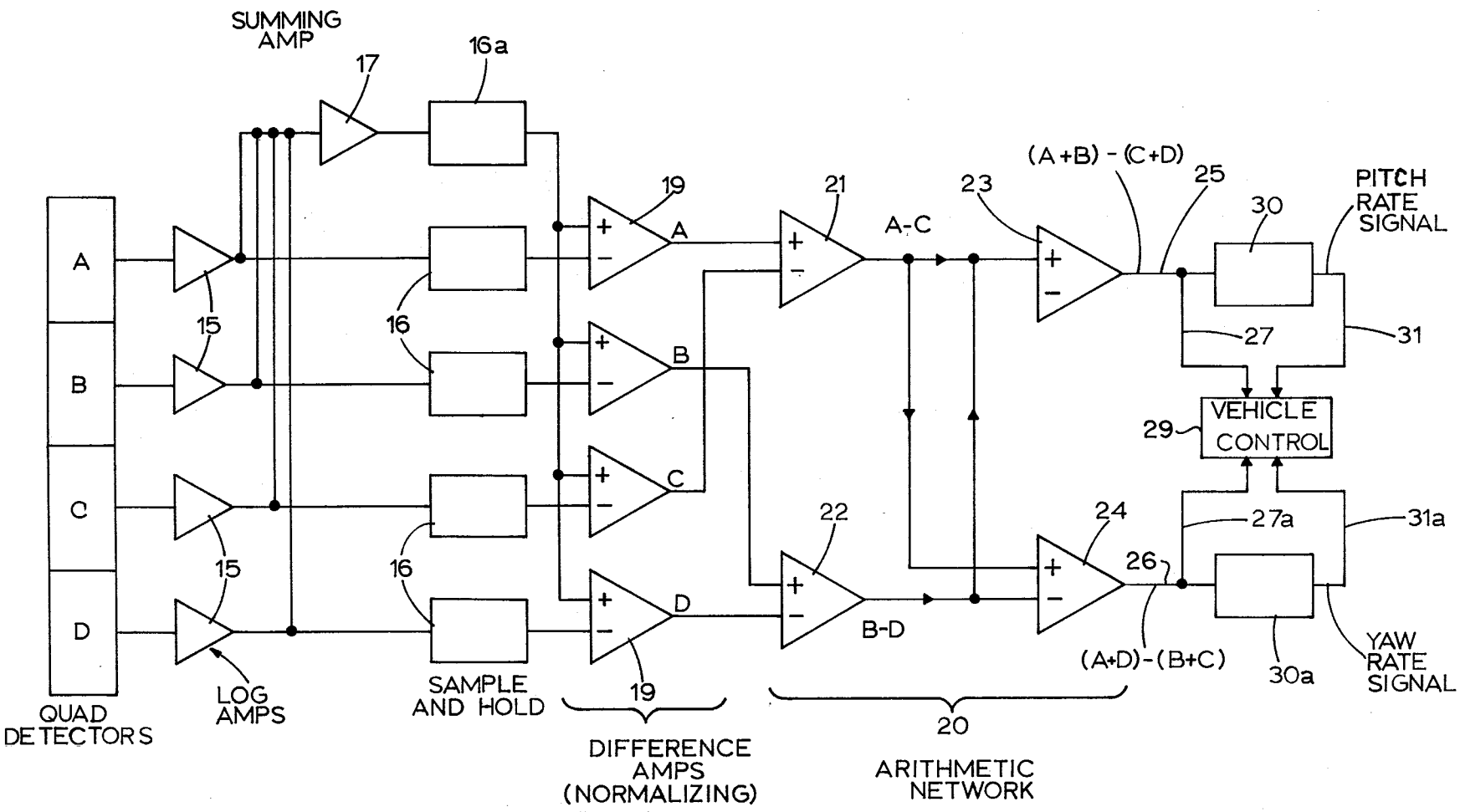
FIG. 5 is a block diagram of the electronic circuitry between the four-quadrant detector and the vehicle flight control apparatus.

The electronics for handling the electrical output signals from sectors or transducers A, B, C and D are shown in block form in FIG. 5. First, each of the four channel signals is passed through a logarithmic amplifier 15. Such amplifiers are used to obtain a compressed output and sharply reduce the chances of saturation or too high a noise level with the desired signal. The circuitry is not necessarily restricted to log amplifiers, however, since it is possible to employ normal amplifiers along with a suitable ACC control. Each signal then goes to a sample and hold circuit 16 to change the pulses to a varying dc level proportional to each successive pulse. A summing amplifier 17 adds all four of the signals together before passing the sum to its sample and hold circuit 16*a*.

Since the amplitude of received pulses drops considerably with range, the four individual signals are normalized before further operation. The normalized signal in each detector channel is produced by feeding the individual signal to a normalizing difference amplifier 19 which also receives the total signal from the sample and hold circuit 16a.

To obtain the required difference signals for pitch and yaw error, the normalized detector signals are processed in an arithmetic network 20 made up as follows. An A–C signal is obtained by feeding A and C to the proper separate inputs of a first subtraction amplifier 21 (a difference amplifier). A B–D signal is similarly obtained by feeding B and D into a second subtraction amplifier 22. Then the A-C and the B-D signals are added together and fed to the plus input of a third subtraction amplifier 23 (no signal goes to the minus input). Further, the A-C signal is fed to the plus input of a fourth subtraction amplifier 24, and the B-D signal is fed to the minus input thereof. It can be seen that the proper pitch error magnitude signal appears on output line 25 from third subtraction amplifier 23, and the proper yaw error magnitude signal appears on output lead 26 from fourth subtraction amplifier 24. This is the minimum number of amplifiers needed to produce the required error signals from the four normalized individual quadrant signals.

The pitch and yaw error signals may be fed on deviation input lines 27 and 27*a* to a vehicle control 29 such as a suitable autopilot, which controls actuating links (not shown) to the fins 7. The pitch and yaw signals are also fed to differentiatng circuits 30 and 30a to obtain the pitch rate signal and the yaw rate signal. These rate signals are fed on rate input lines 31 and 31*a* to the vehicle control 29. In certain stabilizing systems both the amplitude and rate signals are used to provide corrective control while in other systems only the rate signals may be required, as is known in the art.

These rate signals are the stabilization controlling signals commonly supplied to the autopilot or a missile or similar vehicle by rate gyros. It is thus seen that the present invention does the same thing as the rate gyros usually used for pitch and yaw stabilization.

In this system, the four-quadrant detector 10 can be located at the focal point F of lens 9 and the light spot 11 made suitably large by defocusing the optical receiving system or by increasing the laser beam divergence angle at the expense of received signal strength. If the error signal magnitude is objectionally non-linear, simple electronic gain control networks can be used for correction.

In a similar system embodying the present invention but using an electromagnetic radio beam as the transmitted stabilization control link, the four-quadrant photodiode detector would be replaced by a suitable four-quadrant antenna array. However, the laser beam-rider system described herein is virtually jam proof from interfering electromagnetic signals of any kind. Moreover, if the projectile 1 were a space vehicle, the control fins 7 could be replaced by small corrective jet propulsion units for example without departing from the principles of the present invention.

While in order to comply with the statute, the invention has been described in language more or less specific as to structural features, it is to be understood that the invention is not limited to the specific features shown, but that the means and construction herein disclosed comprise the preferred mode of putting the invention into effect, and the invention is therefore claimed in any of its forms or modifications within the legitimate and valid scope of the appended claims.

What is claimed is:

1. In a flight vehicle having flight control means and using a remote transmitted control beam; a pitch-yaw stabilization system comprising:

1 a. focusing lens means mounted in the rear of said vehicle to receive the transmitted beam, the directional axis of said lens means being parallel to the longitudinal axis of said vehicle;

b. a beam detector assembly comprising four separate quadrant shaped transducers positioned together in substantially a circle to form a vertical and horizontal axis with respect to said vehicle passing between said quadrant shaped transducers, said detector being fixed in a plane perpendicular to the directional axis of said lens means and forward of said lens in said vehicle near the focal point of said lens means;

c. a separate signal output lead from each of said quadrant shaped transducers;

d. signal handling means connected to said transducer output leads for producing corrective pitch and yaw rate signals in accordance with the rate of change of said vehicle about the pitch and yaw axes thereof relative to the line of sight of the transmitted beam; and e. means operatively connected from said signal handling means to the flight control means of said vehicle for nulling out oscillations of said vehicle about said pitch and yaw axes.

2. Apparatus in accordance with claim 1 wherein said signal handing means comprises:

a. signal amplifiers connected to said transducer output leads;

b. an arithmetic network, and means connecting said amplifiers to said network, for producing error signals proportional to pitch and yaw deviation of said vehicle; and c. rate signal means connected to the output of said arithmetic network for producing rate signals proportional to pitch and yaw rate deviation of said vehicle.

3. Apparatus in accordance with claim 1 wherein:

a. said focusing lens means comprises an optical lens for receiving a light beam and forming a light spot of predetermined size on said beam detector assembly, said detector assembly positioned away from the focal point of said lens a distance wherein a light spot intercepted on said detector assembly from a remote transmitted light beam through said lens has a diameter approximately equal to the radius of said detector assembly; and b. said detector assembly comprises four photoelectric transducers.

4. Apparatus in accordance with claim 3 wherein said signal amplifiers are logarithmic amplifiers.

* * * * *